United States Patent [19]

Reuter

[11] Patent Number: 4,909,152

[45] Date of Patent: Mar. 20, 1990

[54] CARTRIDGE FOR THE EXPULSION OF LIQUIDS UNDER PRESSURE

[75] Inventor: Ingolf Reuter, Dornhan, Fed. Rep. of Germany

[73] Assignee: Mauser-Werke Oberndorf GmbH, Oberndorf, Fed. Rep. of Germany

[21] Appl. No.: 226,239

[22] Filed: Jul. 29, 1988

[30] Foreign Application Priority Data

Aug. 8, 1987 [DE] Fed. Rep. of Germany ..... 3726490

[51] Int. Cl.[4] ..... F42B 11/00

[52] U.S. Cl. ..... 102/439; 102/430; 102/501; 102/517; 175/2; 175/4.57

[58] Field of Search ..... 102/430, 439, 440, 501, 102/512, 513, 517, 532; 222/386; 175/2, 4.57, 4.58

[56] References Cited

U.S. PATENT DOCUMENTS

| | | | |
|---|---|---|---|
| 692,819 | 2/1902 | Bissell | 102/440 |
| 1,741,901 | 12/1929 | Alden | 102/439 |
| 2,530,805 | 11/1950 | Bond | 175/4.58 |
| 3,649,020 | 3/1972 | Hall | 102/513 |
| 3,650,213 | 3/1972 | Abbott et al. | 102/439 |
| 3,732,821 | 5/1973 | Royer | 102/512 |
| 3,776,137 | 12/1973 | Abbott | 102/439 |
| 4,449,458 | 5/1984 | Buckley et al. | 102/430 |

FOREIGN PATENT DOCUMENTS 3545737 2/1987 Fed. Rep. of Germany .

*Primary Examiner*—Harold J. Tudor

*Attorney, Agent, or Firm*—Scully, Scott, Murphy & Presser

[57] ABSTRACT

A cartridge for the expulsion of liquids under pressure, including a chamber for a propellent charge and a separating arrangement which is located intermediate the chamber for the propellent charge and a liquid chamber. The separating arrangement is constituted as a propulsion mechanism which consists of a driving member, and a closure element which is detachably connected therewith at the end surface of the former.

6 Claims, 2 Drawing Sheets

CARTRIDGE FOR THE EXPULSION OF LIQUIDS UNDER PRESSURE

BACKGROUND OF THE INVENTION

1. Field of the Invention

The present invention relates to cartridge for the expulsion of liquids under pressure, including a chamber for a propellent charge and a separating arrangement which is located intermediate the chamber for the propellent charge and a liquid chamber.

A cartridge of this type serves for utilization in a so-called hydraulic or water hammer, which represents a cannon-like apparatus. Through the intermediary of such water hammers, water columns are fixed in order to be able to loosen vestigial rock or stone cores; for example, for underground or mining tunneling or gallery construction. Hereby, it is of particular advantage, that for this apparatus there can be avoided the ordinarily usual dangerous formation of sparks, as well as an uncontrolled flying around of stone or rock fragments during blasting.

The utilization of this water hammer in a driving gallery is hereby undertaken in such a manner that with the aid of a gallery or tunneling-profile cutting machine, by means of high-pressure water there is initially cut out a semicircularly-shaped driving gallery section of about 0.5 m to 1 m at its edge. Hereby, the gallery or tunnel core remains intact. Into this core there are then drilled holes in a precalculated arrangement or pattern. The comminuting of the core of the gallery there is now carried out with the water hammer, for which purpose water is fired at a high velocity of about 1,000 m/s into the drilled hole. Hereby, pressures in the magnitude of a few thousand bar are produced in the drilled hole. Through this pressure impact there is then comminuted the stone or rock.

2. Discussion of the Prior Art

From the disclosure of German Patent No. 35 45 737 there has already become known a cartridge for the expulsion of liquids, especially of water, under pressure.

This prior art cartridge possesses a cylindrical liquid chamber and a chamber for a propellent charge which is located ahead of this liquid chamber and is separated therefrom by means of a separating arrangement. In this instance, the separating arrangement is formed as a piston with a hollow space, which piston contacts the inner wall surface of the chambers, and wherein the end surface of the piston which faces towards the liquid chamber possesses at least one breaking location. The tip of the cartridge is configured in a nozzle-shape. This cartridge which is constituted from the propellent charge chamber, the separating element and the liquid chamber is inserted into a firing installation in readiness for firing; in essence, equipped, on the one hand, with the propellent charge and, on the other hand, with the liquid. Hereby, it is considered as being disadvantageous that the liquid is contained in the liquid chamber and, as a consequence thereof, special measures are necessary in order to avoid the egress of liquid. In addition thereto, there must also be taken into account the not quite insignificant increase in the weight of such a cartridge.

SUMMARY OF THE INVENTION

Accordingly, it is an object of the present invention to provide a cartridge for the expulsion of liquids of the above-mentioned type in which there is attained a separate supplying or charging of the propulsion components and of the quantity of liquid which is to be propelled, at a generally more compact type of construction for the entire cartridge.

The foregoing object is inventively achieved in that the separating arrangement is constituted as a propulsion mechanism which consists of the propulsion member, and a closure element which is detachably connected therewith at the end surface of the former.

In this inventive cartridge for the expulsion of liquids under pressure, the propulsion mechanism allows for the separate supplying or charging with the propulsion components, cartridge casing with igniter or detonator, powder propellent charge, propulsion mechanism body, front sealing element, and the liquid quantity which is to be propelled. As a result thereof, there is achieved an overall compact type of construction for the apparatus and for the cartridge.

The propulsion components, namely the container for the propellent charge with the propulsion mechanism, are introduced from the breech mechanism of the weapon or from a corresponding loading device into the cartridge chamber of the weapon barrel. The cartridge chamber is closed by the breech mechanism and locked. The quantity of liquid which is to be fired can simply be pumped in through a radial bore in the weapon barrel and the inset of a non-return valve between the two propulsion mechanism body components whereby, due to the pressure of the liquid, these two propulsion mechanism body components will separate from each other at their connecting location. This signifies that the closure element in the weapon bore is displaced forwardly towards the muzzle of the weapon barrel, and thereby sealing contacts along its outer circumference against the inner mantle surface of the bore of the weapon.

Further features and advantages of the invention may now be readily ascertained from the following detailed description of an exemplary embodiment thereof, taken in conjunction with the accompanying drawings; in which.

DETAILED DESCRIPTION

In the cartridge 1 for the expulsion of liquids under pressure, especially water, there is inserted a propulsion mechanism 4 constituting a separating arrangement intermediate a propellent charge chamber 2 and a liquid chamber 3.

Figure 1:
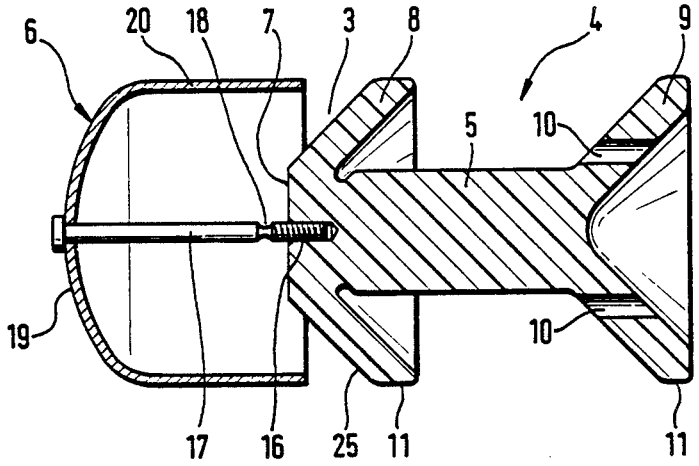
FIG. 1 illustrates a longitudinal sectional view through a first embodiment of a propulsion mechanism for the cartridge.
Figure 2:
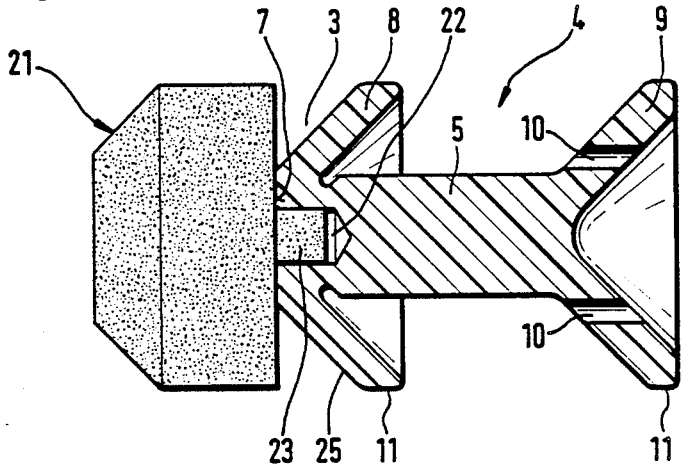
FIG. 2 illustrates a longitudinal sectional view through a further embodiment of a propulsion mechanism for the cartridge.

This propulsion mechanism 4, in accordance with FIG. 1, consists of a driving member 5 of a plastic material; for example, polyamide, and a closure or sealing element 6 which is axially arranged at the head end of the driving member 5. The driving member 5 of the propulsion mechanism 4, pursuant to FIG. 1, as well as according to FIG. 2, is essentially constituted of a solid cylindrical body, which possesses a frontal planar or flat end surface 7, attached to which there is a conically rearwardly widening ring 8. An equivalently configured ring 9 is located at the tail end of the driving member 5, which further possesses through-bores 10 extending in parallel with the longitudinal axis of the propulsion mechanism 4. The outer mantle surface 11 of the rings 8 and 9, under a light prestressing, is located closely against the inner jacket surface 12 of the cartridge casing 13 or, respectively, the inner jacket surface 14 of the weapon bore 15. In the frontal end surface 7 there is provided a central bore possessing a screwthread 16, into which there is screwed a pin 17 with a breaking location 18, which is located axially exteriorly of the driving member 5 of the propulsion mechanism 4. The pin 17 carries the closure element 6 which possesses a ball-shaped or spherically-curved end surface 19 having a cylindrically-shaped component 20 attached thereto. This cylindrically-shaped component 20 corresponds in its outer diameter, under a light prestressing, closely to the inner diameter of the weapon bore 15. Alternatively, the cylindrical component 20 can be slightly conically-shaped towards its rearwardly open end, such that at an easier introduceability, there takes place a sealing contact of the closure element with the inner jacket surface 14 of the weapon bore 15.

In FIG. 2 of the drawings there is illustrated another type of the propulsion mechanism 4 with a closure element 21. The driving member 5 of the propulsion mechanism 4 is configured in conformance with the propulsion mechanism of FIG. 1. Instead of the form-fitted connection of the closure element 6 with the driving member 5 in FIG. 1, in FIG. 2 there is provided a force-transmissive connection between the closure member 21 and the driving member 5. For this purpose, a blind bore 22 is formed in the again planar end surface 7 of the driving member 5. The closure member 21, which in this instance is constituted from a polyurethane foam, possesses a rearward central protuberance 23 which is press-fitted into the blind bore 22. The closure element 21, in the embodiment pursuant to FIG. 2, has conical shape with a flat tip which is slightly modified with regard to the spherical or ball-shaped end surface. The outer mantle surface of this closure element 21 which is produced from a polyurethane foam, again contacts closely or sealingly against the inner jacket surface 14 of the weapon bore 15. The annular space 3 between the jacket surface 25 of the ring 8 and the closure element 6 or respectively 21, presents an increasable liquid chamber, which is in communication with a radial supply opening 26 in the weapon barrel 24.

Figure 3:
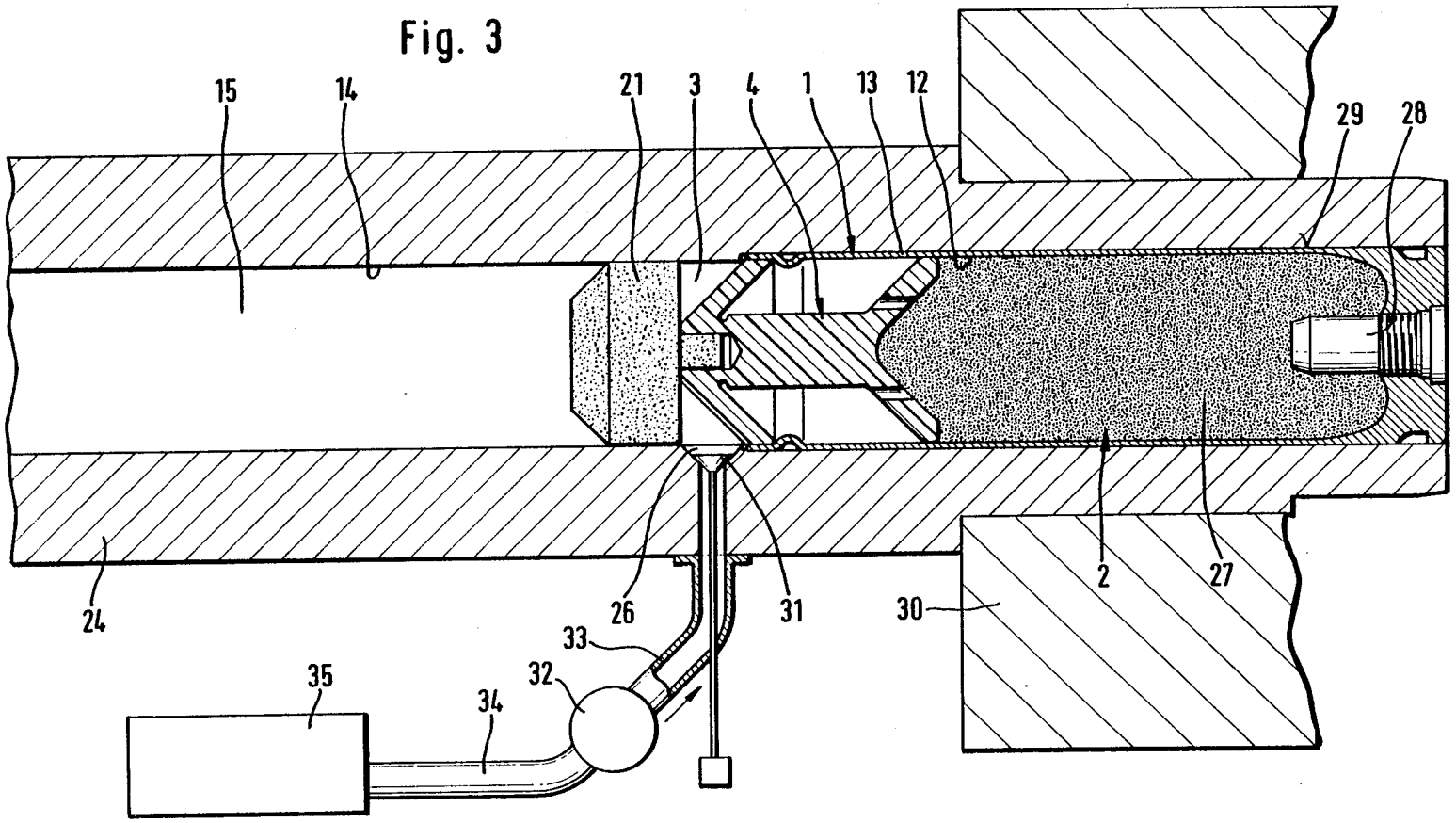
FIG. 3 illustrates a longitudinal sectional view through a complete cartridge for the expulsion of liquids under pressure in a weapon barrel.

As can be ascertained particularly from FIG. 3, the entire cartridge is constituted from the propulsion mechanism 4 which in the example of FIG. 3, is inserted into the cartridge casing 13. Located in the cartridge casing towards the rearward end thereof is the propellent charge chamber 2 with the necessary propellant 27. The closure in the cartridge casing forms the triggering or detonating element 28. In the described manner, in a force-transmissive manner, a closure element 21 is introduced into the frontal end surface of the propulsion mechanism 4. The entire cartridge 1 is located within the cartridge chamber 29 of the weapon housing 30 together with the breech loading mechanism (not shown). The weapon barrel 24 is suitably latched in the weapon housing 30, in a manner not illustrated herein. Arranged in the essentially radial supply opening 26 of the weapon barrel 24 is a non-return valve 1, which is connected with a hydraulic pump 32 through a conduit 33. A further conduit 34 is arranged to extend between a liquid supply container 35 and the hydraulic pump 32.

As can be ascertained from the illustration of FIGS. 1 to 3, the inventive propulsion mechanism 4 allows for the separate supplying and charging of the propulsion components; namely the cartridge casing 13 with the detonator 28, the powder propellent charge 27, the driving member 5 and the forward closure element 21 or respectively 6, and the liquid which is to be propelled; for example, such as water, from the container 35 to the liquid chamber 3.

The entire charging sequence takes place essentially as follows:

The propulsion components are conveyed from the breech loading mechanism, or a corresponding infeed arrangement, into the cartridge chamber 29 of the weapon barrel 24. The cartridge chamber 29 is hereby closed off by the breech loading mechanism (not shown) and then locked. The quantity of liquid which is to be fired is pumped in through the supply opening 26 in the weapon barrel 24, with the interposition of a non-return valve 31, from a hydraulic pump 32 into the annular chamber between the closure element 21 or 6 and the driving member 5 of the propulsion mechanism 4. Due to the generated liquid pressure, there takes place an axial separation between the closure element 21 or 6 and the driving member 5. In the instance of the closure element 21, the friction force within the bore 22 is overcome, whereas in the case of FIG. 1, the breaking location 18 will fracture because of the encountered liquid pressure. Because of the liquid which follows along under pressure, the closure element 21 or 6 is slid forwardly in the weapon bore 14 in the direction towards the muzzle of the weapon barrel while overcoming the external frictional force. Hereby, the cylindrical portion of the closure element 21 or 6 are always sealingly and under a light pressure in contact with the inner jacket surface 14 of the weapon bore 15. When the supplying of liquid is then terminated, pressure is no longer available for the displacement of the closure element 21 or 6. This closure element 21 or 6 remains standing and, as a result, forms the front seal for the liquid in the weapon barrel 24. The driving member 5 is maintained in its position during the supplying of the liquid through the cartridge casing 13, and forms the rear seal for the liquid.

After this supplying sequence of the liquid has been carried out the entire apparatus or a cartridge is then in readiness for firing. Upon the triggering of this cartridge 1, in response to the gas pressure from the powder, the driving member 5 of the propulsion mechanism 4, the liquid column ahead of the propulsion mechanism 4, and the front closure element 21 or 6 are driven out of the weapon barrel 24. This results at a high velocity of approximately 1,000 m/s. The water is hereby propelled similar to a projectile by means of the propulsion mechanism 4 due to the pressure of the burning-down propellent charge 27. In the utilization of this so-called water hammer in gallery or tunneling construction for mining operations, this water column is fired into the drilled holes of the gallery core. Through the extremely high pressure impact of a few thousand bar, the stones or rocks within the gallery core are comminuted.

What is claimed is:

1. A cartridge for the expulsion of liquids under pressure from a bore of a barreled weapon; said cartridge comprising a chamber for a propellent charge and a liquid chamber ahead of said propellent charge chamber in said bore; a separating arrangement being located between the propellent charge chamber and said liquid chamber, said separating arrangement including a propulsion mechanism consisting of a driving member and a closure element detachably connected to a leading end surface of said driving member in said bore so as to form said liquid chamber therebetween, said closure element and leading end of said driving member having outer circumferential surfaces sealing contacting said bore, said closure element being separable from said driving member in said bore in response to liquid being injected under pressure into said liquid chamber so as to form a liquid column intermediate said closure element and said driving member in said weapon bore.

2. A cartridge as claimed in claim 1, wherein said driving member includes an axial bore in the leading end surface thereof, said closure element having a rearwardly extending protuberance engaging in close-fitting engagement into said bore in the end surface of said driving member and being separable therefrom in response to injection of liquid into said liquid chamber.

3. A cartridge as claimed in claim 1, wherein said closure element is constituted from a plastic material.

4. A cartridge as claimed in claim 3, wherein said plastic material consists of a polyurethane foam.

5. A cartridge as claimed in claim 1, wherein said driving member includes a conical seal ring having an outer diameter sealingly contacting said weapon bore and extending from said leading end surface which is in connection with said closure element, said liquid chamber being formed intermediate said seal ring, said closure element and said weapon bore, and being in communication with a source of pressurized liquid through an aperture in said barreled weapon in alignment therewith.

6. A cartridge as claimed in claim 5, wherein said driving member includes a second seal ring axially spaced rearwardly of said first seal ring and bounding said propellent charge chamber, said second seal ring having a shape similar to said first seal ring and including at least one axial through-bore extending in parallel with the longitudinal axis of the cartridge communicating with said propellent charge chamber.

* * * * *

UNITED STATES PATENT AND TRADEMARK OFFICE

CERTIFICATE OF CORRECTION

PATENT NO. : 4,909,152

DATED : March 20, 1990

INVENTOR(S) : Ingolf Reuter

It is certified that error appears in the above-identified patent and that said Letters Patent is hereby corrected as shown below:

Column 1, line 7: "to cartridge" should read as --to a cartridge--

Column 3, line 65: "1" should read as --31--

Signed and Sealed this

Thirtieth Day of July, 1991

*Attest:*

*Attesting Officer*

HARRY F. MANBECK, JR.

*Commissioner of Patents and Trademarks*